US006786208B1

(12) United States Patent
Velez-Velez

(10) Patent No.: US 6,786,208 B1
(45) Date of Patent: Sep. 7, 2004

(54) BOOST FUEL ENRICHER

(76) Inventor: Hector H. Velez-Velez, P.O. Box 312, Guayama, PR (US) 00785-0312

( * ) Notice: Subject to any disclaimer, the term of this patent is extended or adjusted under 35 U.S.C. 154(b) by 0 days.

(21) Appl. No.: 10/457,532

(22) Filed: Jun. 10, 2003

(51) Int. Cl.[7] ..... F02B 33/00; F02M 7/00; F02M 7/14

(52) U.S. Cl. ..... 123/559.1; 123/439; 123/437; 261/69.1; 261/DIG. 12; 261/DIG. 51; 261/DIG. 68; 137/494

(58) Field of Search ..... 123/559.1, 437, 123/439; 137/494, 536; 261/69.1, DIG. 12, DIG. 68, DIG. 51

(56) References Cited

U.S. PATENT DOCUMENTS

| | | | | | |
|---|---|---|---|---|---|
| 1,069,576 | A | * | 8/1913 | Le Pontois | 261/DIG. 12 |
| 1,153,436 | A | * | 9/1915 | McCray | 261/DIG. 12 |
| 1,465,449 | A | * | 8/1923 | Maegly | 261/69.1 |
| 1,946,284 | A | * | 2/1934 | Huber | 261/69.1 |
| 2,070,009 | A | * | 2/1937 | Goodman | 123/437 |
| 2,223,381 | A | * | 12/1940 | Mock | 261/DIG. 51 |
| 2,502,602 | A | * | 4/1950 | Stresen-Reuter | 261/69.1 |
| 2,652,237 | A | * | 9/1953 | Boller | 261/69.1 |
| 2,670,940 | A | * | 3/1954 | Hunt | 261/69.1 |
| 3,531,094 | A | * | 9/1970 | Andrew | 261/69.1 |
| 4,241,711 | A | | 12/1980 | Deweiler | 123/559.1 |
| 4,307,692 | A | * | 12/1981 | Fiala | 261/69.1 |
| 4,308,835 | A | * | 1/1982 | Abbey | 123/439 |
| 4,558,680 | A | | 12/1985 | Nakazato | 123/559.1 |
| 4,658,798 | A | | 4/1987 | Yogo et al. | 123/559.1 |
| 5,241,931 | A | * | 9/1993 | Radel | 261/DIG. 68 |

FOREIGN PATENT DOCUMENTS

| | | | | |
|---|---|---|---|---|
| JP | 57028854 | A | * 2/1982 | 261/DIG. 12 |

OTHER PUBLICATIONS

H. MacInnes, *Turbochargers,* The Berkley Publishing Group, New York, 1984, pp. 54–58.

P. Ganahl, *Street Supercharging,* CarTech, Inc., North Branch, Minnesota, 1999, pp. 107–118.

* cited by examiner

*Primary Examiner*—Thai-Ba Trieu
(74) *Attorney, Agent, or Firm*—Richard C. Litman

(57) ABSTRACT

The boost fuel enricher is used with internal combustion engines, either carbureted or fuel-injected, that are equipped with compressors, i.e., turbocharged or supercharged, in order to enrich the air/fuel ratio when the engine is under boost. The boost fuel enricher is a diaphragm pressure valve with an adjustable throat. The diaphragm is subject to atmospheric pressure on one side, and senses inlet air pressure in the air intake passage on the other side. When inlet air pressure exceeds atmospheric pressure, the valve opens to admit additional air-fuel mixture into the air intake passage through a venturi in the air intake passage. The throat is made adjustable by sliding block valves in the fuel passage.

8 Claims, 9 Drawing Sheets

BOOST FUEL ENRICHER

BACKGROUND OF THE INVENTION

1. Field of the Invention

The present invention relates to boost fuel enrichers used in internal combustion engines equipped with a turbocharger or supercharger. More specifically, the enricher is a device which is usable in carbureted or fuel injected engines with a boost pressure from a turbocharger or supercharger in a blow-through configuration, and which mechanically bypasses more fuel into the air-fuel mixture in order to avoid lean operation.

2. Description of the Related Art

A naturally aspirated internal combustion engine has a volumetric efficiency which is less than 100%. In order to compensate for this problem, many vehicles are equipped with a compressor in the form of a supercharger, in which the compressor is driven either directly by the crankshaft or indirectly by a belt and pulley, or in the form of a turbocharger, in which the compressor is mounted on the same shaft as a turbine driven by the engine's exhaust gases. The compressor enables a greater density of air to enter the engines cylinders through the intake manifold. The greater density of air in the cylinders permits more complete combustion of the fuel, and a greater mass of gas pushing against the piston, thereby generating more horsepower.

However, one problem associated with supercharged and turbocharged engines is proper adjustment of the air/fuel ratio. In a naturally aspirated engine, a vacuum develops in the intake manifold. When the throttle is opened, air at atmospheric pressure enters the intake manifold to fill the vacuum. The stoichiometric air/fuel ratio is about 14.5:1. The fuel system in a naturally aspirated engine is designed to deliver fuel at a slightly richer ratio under load, about 12:1 to 13:1.

In a supercharged or turbocharged engine, however, the air in the intake manifold is more dense, with pressures often greater than atmospheric. The boost pressure is often defined as the difference between barometric pressure and the pressure in the intake manifold in a supercharged or turbocharged engine. The boost pressure in an automobile designed for ordinary highway use often reaches a pressure of 8–10 psi of boost. Unless a greater quantity of fuel is added to the air/fuel mixture than would be provided in a naturally aspirated engine, the engine may run lean, leading to detonation. In a street machine, detonation can result in damage to the piston, rings, head gasket and other components. In a racing vehicle, which may use aluminum rods and pistons, detonation may result in more sever damage, such as a broken rod and resultant damage to the crankshaft and cylinder walls.

In modern fuel injection engines, this problem is usually addressed by the mass air flow sensor and the electronic engine control, which controls the frequency and duration of the injection pulses according to the quantity of air sensed by the mass air flow sensor. Many engines also have a knock sensor, which may also signal the electronic engine control to increase fuel injection when knock indicative of detonation is sensed. Some fuel injection engines run with little or no modification with a supercharger or turbocharger. Other fuel injection systems require pressure or temperature sensors, or are not programmed or mapped to handle boost pressures above atmospheric pressure, and therefore require chip replacement.

In any event, fuel injection systems frequently respond on the basis of historical data, i.e., the sensors do not respond dynamically to correct the condition sensed, but merely transmit the information to the electronic engine control where the information reported from multiple sensors is analyzed. Further, a response to sensor input may not be formulated immediately. The electronic engine control may have a delay built in to require that the sensor input be repeated over a predetermined time interval to eliminate spurious data before responding. Only then does the controller send an appropriate signal to an actuator or transducer to initiate corrective action, so that in electronic fuel injection systems, there may be a time lag in responding to high boost pressures in the intake manifold.

In carbureted engines, when a supercharger or turbocharger is added, usually a higher octane gasoline is selected to prevent detonation. Other measures include retarding spark ignition, enriching the air/fuel mixture, and cooling the intake charge by water injection or an intercooler. Enriching the fuel mixture usually involves increasing the size of the jets, changing the spring on the main power piston or metering rod, adjusting the idle screw, and other such measures. However, these measures can prove to be quite expensive. It is not unheard of for adjustments to the carburetor and fuel system of a racing car to cost into the five figure range, depending upon the fuel being used. Further, these adjustments cause the engine to run rich whether operated under a light or heavy load. P. Ganahl in *Street Supercharging* (CarTech, Inc., North Branch, Minn., 1999) describes several such adjustments at pp. 107–118.

Superchargers and turbochargers may be mounted in different configurations. In a "blow-through" configuration, the compressor is upstream from the carburetor, and blows dry air into the carburetor air horn. In a "draw-through" configuration, the compressor is mounted between the carburetor and the intake manifold, and draws an air-fuel mixture into the manifold. The draw-through configuration presents another problem when used with a carburetor designed for naturally aspirated engines.

As explained by H. MacInnes in Turbochargers, (The Berkley Publishing Group, New York, 1984) at pp. 54–55, a conventional carburetor has a passage extending from below the throttle plate to a power piston or diaphragm controlling a metering rod. When there is vacuum below the throttle plate, the power valve remains closed, but when the throttle plate is opened, the piston or metering rod opens to allow more fuel to enter the air horn. However, when the throttle is then partially released, as under cruise conditions, the power valve closes. In a draw-through configuration, this may result in the power valve closing while the engine is still under boost, resulting in detonation. MacInnes describes modifications to the power valve to avoid this problem, including plugging the passage and providing a separate passage from the power valve to the intake manifold, thereby bypassing the compressor. However, MacInnes points out that this only solves the problem of proper actuation of the power valve, and not adjusting the air/fuel ratio to the increased boost pressure provided by the compressor.

U.S. Pat. No. 4,241,711, issued Dec. 30, 1980 to C. A. Detwiller, describes a fuel control system which adjusts the response of the main metering rod according to the load in a draw-through turbocharger configuration. The system includes a device having a diaphragm which separates a control chamber connected to the intake manifold downstream from the compressor from a regulating chamber connected to the carburetor plenum between the throttle and the compressor. An output tube is connected between the regulating chamber and a vacuum regulator connected to the metering rod. A bias spring is normally set for a low vacuum output. Differential pressure between the control chamber and the regulating chamber controls the metering rod according to the load. However, this only addresses the power valve actuation problem, and does not address the problem of adjusting the air/fuel ratio to the boost pressure.

MacInnes also describes devices which are directed towards adjusting the air/fuel ratio according to the boost pressure in Turbochargers, supra, at pp. 55–58. One such device is a pressure switch connected to the intake manifold which operates a solenoid valve that opens when boost pressure exceeds a specified limit in order to inject additional fuel into the air horn. Another device described is a pressure activate fuel valve with a diaphragm that opens to admit more fuel to the air horn, the fuel valve sensing pressure in the intake manifold downstream from the compressor. MacInnes also describes an arrangement used with a progressive or multibarrel carburetor in which the secondaries open only when the engine is supercharged to enrich the air/fuel mixture.

U.S. Pat. No. 4,558,680, issued Dec. 17, 1985, shows a system for a blow-through turbocharger with an air diaphragm valve having one chamber connected to the intake passage upstream of the carburetor, and the other chamber connected below the throttle valve, the diaphragm operating a needle valve controlling flow between the air cleaner and an air bleed in the carburetor. The conduit between the air diaphragm valve and the intake manifold has a check valve and a bleed to the atmosphere. When the vehicle is under load, the pressure differential between the air horn and the intake manifold opens the needle valve to supply a rich air/fuel mixture. Otherwise the valve is closed to lean the mixture.

U.S. Pat. No. 4,658,798, issued Apr. 21, 1987 to Yogo et al. describes a turbocharger control system adapted for either a blow-through or a draw-through configuration. The Yogo patent describes a device for providing a lean air/fuel mixture when pressure in the intake manifold exceeds a predetermined limit. The device described by Yogo is essentially designed for smoothing transitions when a predetermined pressure limit is exceeded in the intake manifold.

There is a need for a boost fuel enricher which operates mechanically to enrich the air/fuel mixture when an engine is under boost pressure in order to provide a dynamic, continuous adjustment of the air/fuel mixture.

None of the above inventions and patents, taken either singly or in combination, is seen to describe the instant invention as claimed. Thus a boost fuel enricher solving the aforementioned problems is desired.

SUMMARY OF THE INVENTION

The boost fuel enricher is used with internal combustion engines, either carbureted or fuel-injected, that are equipped with compressors, i.e., turbocharged or supercharged, in order to enrich the air/fuel ratio when the engine is under boost. The boost fuel enricher is a diaphragm pressure valve. The diaphragm is subject to atmospheric pressure on one side, and senses inlet air pressure in the air intake passage on the other side. When inlet air pressure exceeds atmospheric pressure, the valve opens to admit additional air-fuel mixture into the air intake passage through a venturi in the air intake passage.

The valve has an adjustable or variable throat to meter the additional fuel within a range required by the desired boost pressure.

In a carbureted engine, the air intake passage includes the carburetor air horn with a venturi defined therein. Boost pressure is assumed to be the air intake pressure communicated through the carburetor bowl vent tube to the carburetor fuel bowl. From the fuel bowl the air intake pressure is communicated to the inlet of the fuel enricher. When air intake pressure exceeds atmospheric pressure, the valve opens and the air-fuel mixture exits the valve through a conduit which discharges into the venturi of the carburetor air horn.

In a fuel injected engine, a venturi, which may be either an auxiliary venturi or a carburetor body modified by plugging the main jets, idle jets, and other orifices, is placed in the air intake passage either between the compressor and the throttle body, or between the intercooler and the throttle body. In the case of an auxiliary venturi, the fuel enricher has its inlet connected to a regulator attached to the fuel pump, the regulator keeping the pressure at about 1 psig above the boost pressure. In the case of the modified carburetor body, the fuel enricher has its inlet connected to the fuel bowl of the carburetor body and its outlet connected to a discharge tube in the venturi throat, fuel being supplied to the fuel bowl from the fuel pump after being regulated down to about 3.0 to 8.0 psi above the boost pressure.

Accordingly, it is a principal object of the invention to provide a boost fuel enricher for enriching the air/fuel mixture of an engine under boost from a turbocharger or supercharger in order to prevent damage to the engine from a lean air/fuel mixture.

It is another object of the invention is to provide a boost fuel enricher which enriches the air/fuel mixture in an engine under boost by a mechanically operated valve in order to provide and enriched air/fuel mixture dynamically for improved efficiency.

It is a further object of the invention to provide a boost fuel enricher which utilizes the venturi principle to meter the additional fuel required to enrich the air/fuel mixture in an engine under boost from a supercharger or turbocharger.

Still another object of the invention is to provide a boost fuel enricher that is capable of enriching a carbureted or fuel-injected internal combustion engine.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
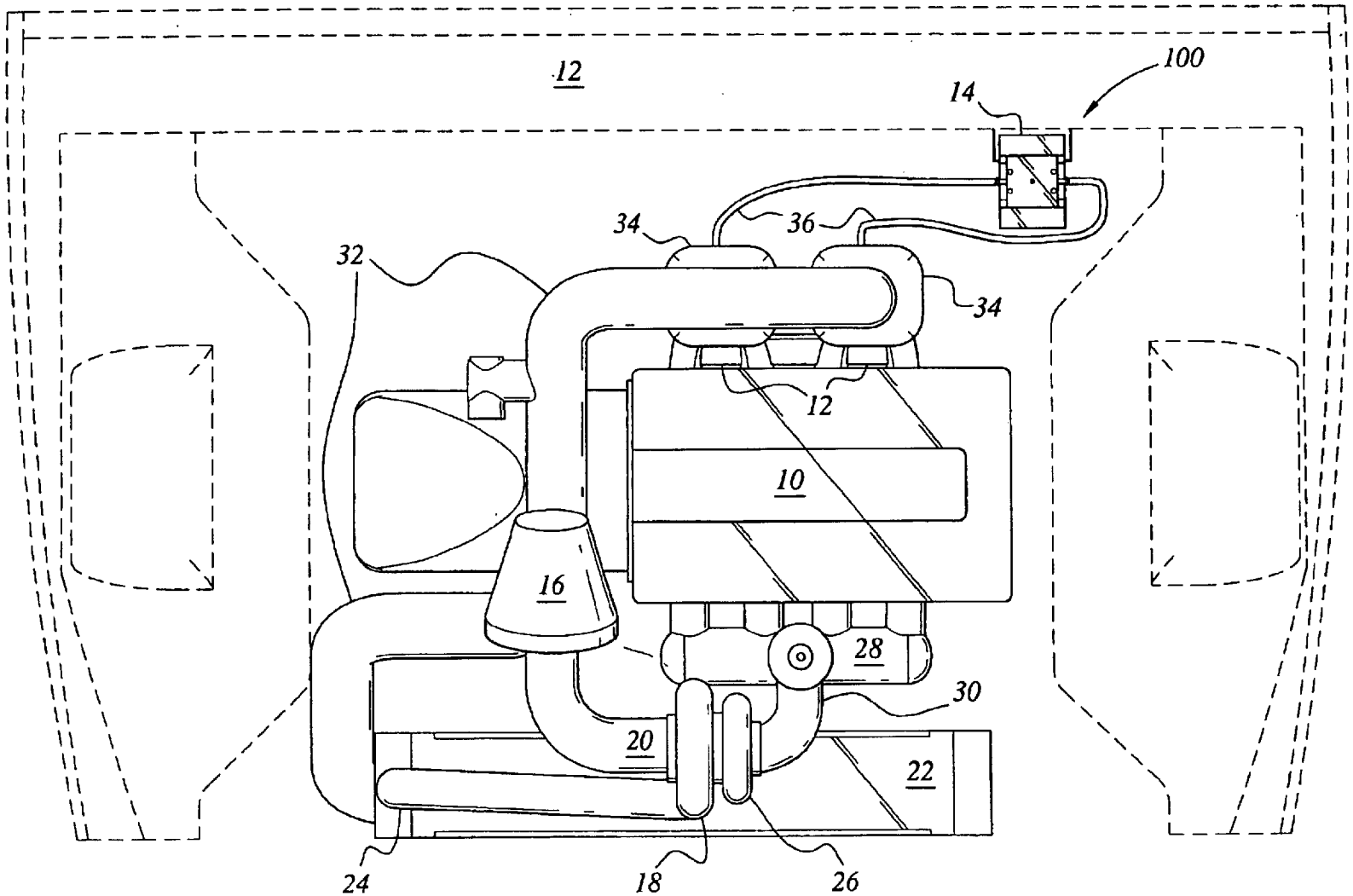
FIG. 1A shows an environmental, plan view of a boost fuel enricher according to the present invention in a carbureted internal combustion engine.

The present invention is a boost fuel enricher usable in carbureted or fuel injected internal combustion engines that are equipped with air inlet compressors. FIG. 1A shows a plan view of a carbureted engine 10 including a boost fuel enricher 100 mounted on the firewall 12 with a support bracket 14. In the configuration shown in FIG. 1A, the engine is turbocharged in a blow-through configuration.

In this type of engine, air enters the engine first through an air filter 16 (shown diagrammatically), then enters the compressor 18 through conduit 20. The air then enters an optional intercooler 22 (used in some engines to further boost performance) through inlet line 24.

The compressor 18 in this case is driven by a turbine 26, which is powered by the exhaust that exits the exhaust manifold 28 and passes to the turbine 26 via conduit 30. Compressor 18 is mounted on the same shaft as turbine 26, so that the compressor 18 is directly driven by the turbine 26.

The air then leaves the optional intercooler 22 through conduit 32 enters the dual carburetors 34 (in a blow-through turbocharger, the air may pass through a plenum before entering the carburetor air horn, the plenum not being shown for clarity), where the air mixes with fuel from the carburetor, as well as with the supplemental fuel provided by the fuel boost enricher 100 through supplemental fuel lines. 36. (The inlet line to the fuel enricher 100 is not shown in FIG. 1A for clarity in the drawings). The fuel-air mixture enters the engine cylinders through the intake manifold runners at 12. It is noted that two carburetors are shown, but the boost fuel enricher can be used with a single carburetor, and that the carburetor 34 may be a single barrel, two-barrel or four-barrel carburetor.

Figure 1B:
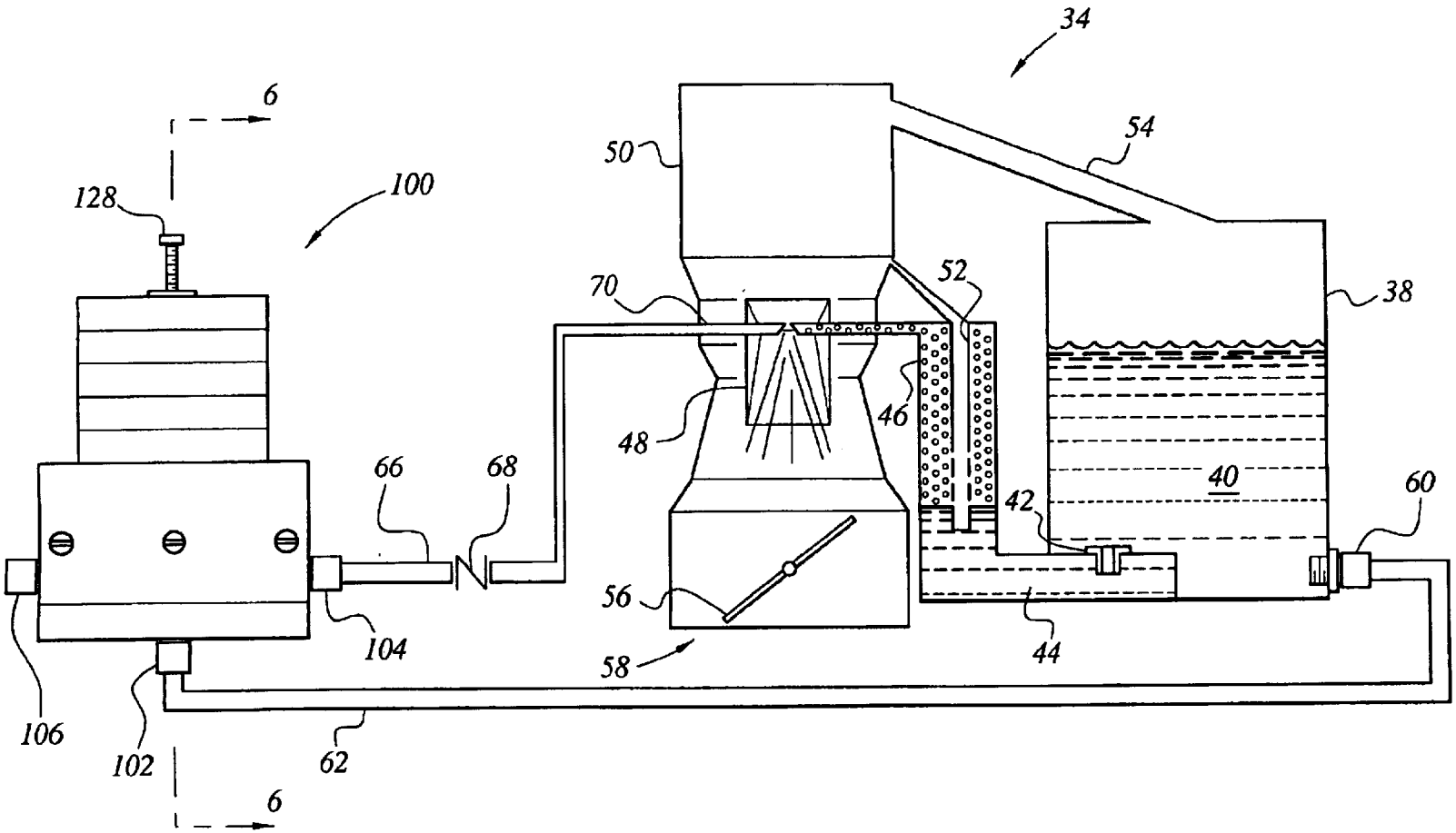
FIG. 1B shows a diagrammatic view of a boost fuel enricher according to the present invention in a carbureted internal combustion engine.

FIG. 1B shows a diagrammatic view of the boost fuel enricher 100 connected to a carburetor 34. In the drawing, only those carburetor components required for an understanding of the present invention are shown, the idle circuit, power circuit, accelerator pump; floats, etc. being omitted for clarity. The carburetor fuel bowl 38 contains fuel 40 provided by a fuel pump (not shown). The fuel 40 passes through a main jet 42 to the main well 44 and passes through a discharge tube 46 and enters the throat of a venturi 48 defined in the air horn 50 of the carburetor 34. Air from the entrance of the air horn 50 passes through orifices defined in a main air bleed tube 52 and atomizes the fuel 40 as it passes through the discharge tube 46. Air is directed through a bowl vent tube 54 to the fuel bowl 38.

Air enters the carburetor air horn 50. The velocity of air increases as it passes through the venturi 48, producing a pressure drop and drawing fuel from the discharge tube 46 in proportion to the pressure drop. Venting the fuel bowl 38 to the mouth of the air horn 50 through the bowl vent 54 ensures a pressure drop between the fuel bowl 38 and the venturi 48. The flow of air through the air horn 50 is controlled by the throttle valve 56 in the usual fashion. The air/fuel mixture exits the carburetor 34 at air horn outlet 58.

Fuel boost enricher 100 draws fuel 40 from the carburetor fuel bowl 38 at fuel outlet 60, the fuel 40 passing through fuel line 62 under system pressure in the carburetor fuel bowl 38. In the blow-through configuration shown in FIG. 1A, this system pressure results primarily air pressure provided by the compressor 18 through bowl vent tube 54, and the resultant pressure exerted on the fuel 40. The fuel enters the enricher 100 at inlet connection 102. Fuel outlet 60 is an appropriate fitting installed in the fuel bowl drain hole, if the carburetor is so equipped; otherwise, a passage may be formed at the base of the fuel bowl 38 for this purpose.

The fuel enricher 100 houses a valve, as described below, which releases a metered volume of fuel through outlet port 104, and optionally through outlet port 106, in response to boost pressure. The additional fuel passes through conduit 66, check valve 68, and is discharged through enricher discharge tube 70 into the venturi 48, thereby enriching the air/fuel mixture blown through the carburetor.

If the boost fuel enricher 100 supplies supplemental fuel to a single barrel carburetor, outlet 106 can be provided with a cap to close an alternative outlet connection used with two barrel carburetors. Conversely, if the engine is equipped with a two barrel carburetor, or dual single barrel carburetors, as in FIG. 1A, the cap can be removed to permit the boost fuel enricher 100 to supply the supplemental fuel to the second barrel or second carburetor. If the fuel enricher 100 is used with a four barrel carburetor, a T-fitting can be placed in the outlet fuel lines to supply the additional barrels.

It is noted that the boost fuel enricher 100 can be mounted at any suitable location within the engine compartment, including a support plate that extends from the carburetor structure (not shown), or can be made integral with the carburetor.

Figure 2:
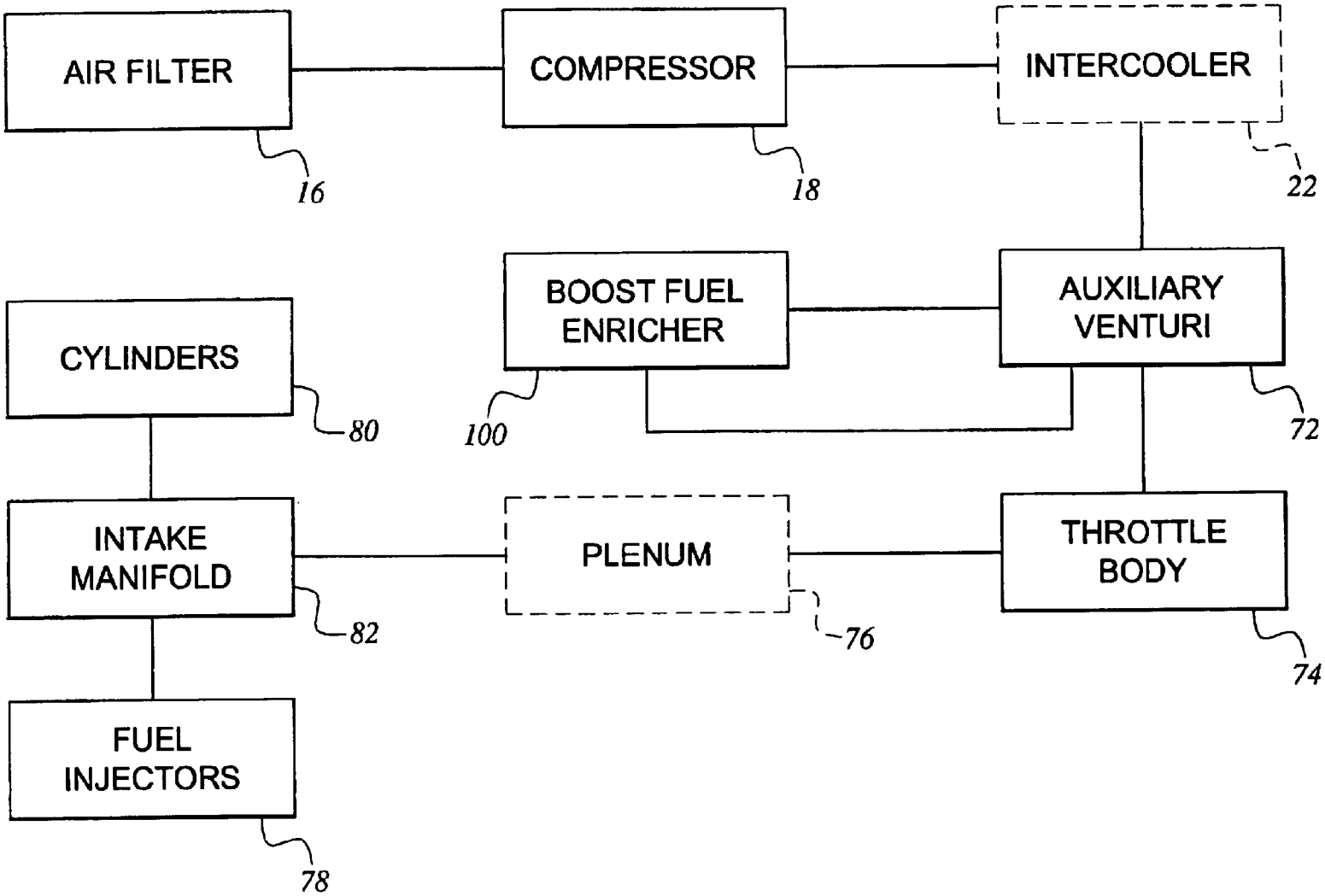
FIG. 2 is an environmental plan view of a boost fuel enricher according to the present invention installed in a fuel-injected engine.

FIG. 2 shows a block diagram of a fuel-injected engine equipped with the boost fuel enricher 100 of the present invention. Air enters the engine through the air cleaner 16 and is compressed in compressor 18, which may be either a supercharger or turbocharger. The compressed air is optionally cooled by intercooler 22 and enters an auxiliary venturi 72. Auxiliary venturi 72 may be a carburetor body similar to carburetor 34 of FIG. 1B, but with the throttle valve 56 removed, and with the idle jets and main jets plugged. The auxiliary venturi 72 has a fuel bowl connected to the fuel tank by a fuel line, fuel pressure to the auxiliary fuel bowl being regulated to about 3.0 to 8.0 psi above the boost or operating pressure. Boost fuel enricher 100 is otherwise attached to the auxiliary venturi 72 in the same manner that the fuel enricher 100 is attached to carburetor 34 in FIG. 1B, i.e., a fuel outlet 104 is connected to a discharge orifice 70 in the venturi, so that additional fuel is metered into the airflow when the pressure of the air provided by the compressor 18 exceeds atmospheric pressure.

Airflow from the auxiliary venturi 72 enters the throttle body 74 and is conveyed to the intake manifold 82, most often through a plenum 76. With port fuel injection, the fuel injectors 78 may be mounted in the intake manifold 82 or directly in the cylinders 80.

Figure 3:
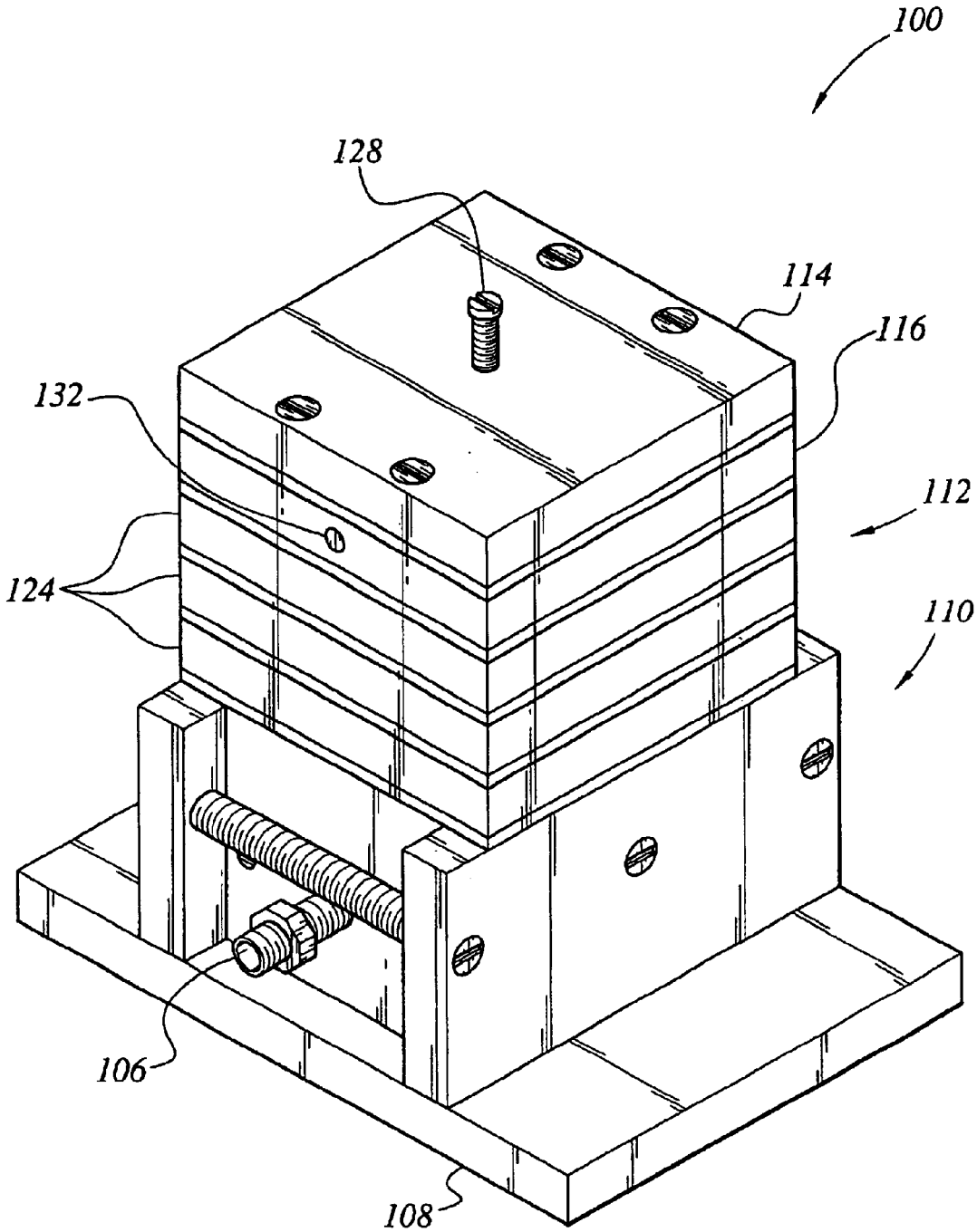
FIG. 3 is a perspective view of a boost fuel enricher according to the present invention fully assembled.
Figure 4:
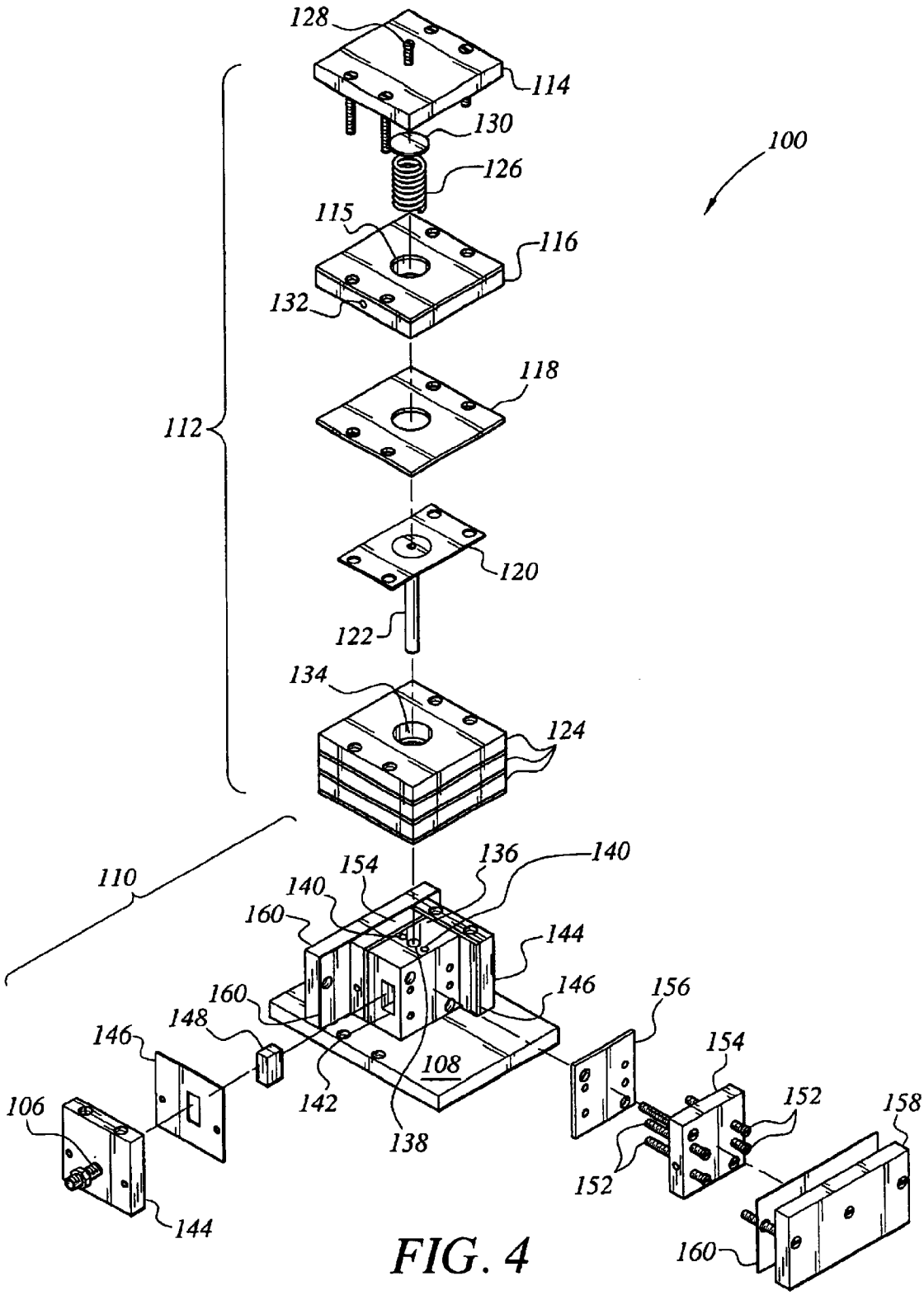
FIG. 4 is an exploded perspective view of the boost fuel enricher according to the present invention.

As shown in FIG. 3, the fuel enricher 100 has a housing including an inlet or base plate 108, on which is mounted a lower housing 110 and an upper housing 112. Referring to Fig. 4, the upper housing 112 forms an enclosure for a spring-biased diaphragm and piston assembly, and the lower housing 110 forms an assembly for a metering block.

In particular, the upper housing 112 includes cover plate 114, chamber plate 116, gasket 118, diaphragm 120 with integral piston 122, and spacer plates 124. Spring 126 is disposed between cover plate 114 and diaphragm 120, bearing against the head of integral piston 122 and extending through a bore 115 defined in chamber plate 116. Spring 126 biases integral piston 122 downward.

Figure 5:
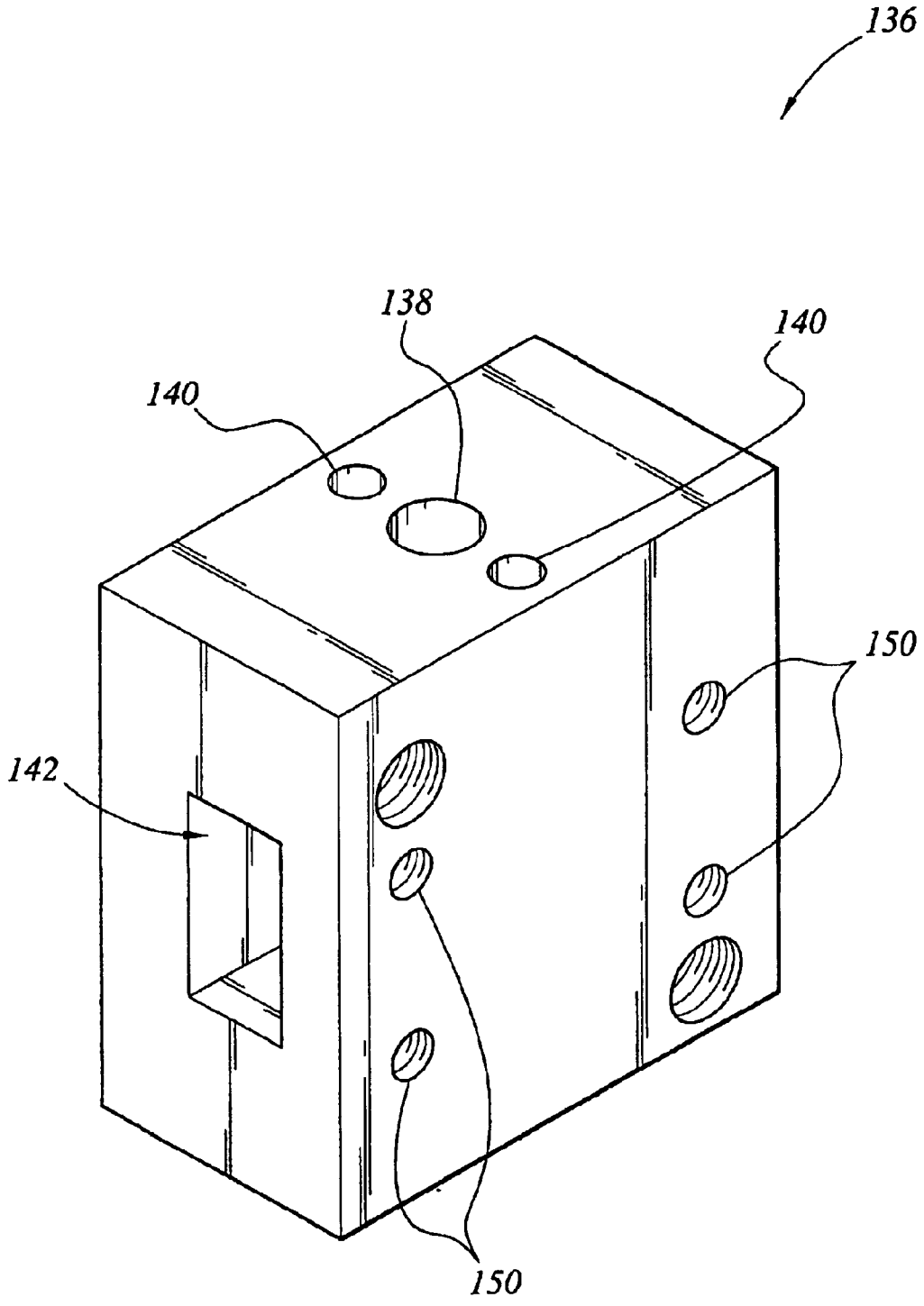
FIG. 5 is a perspective view of the metering block of the boost fuel enricher according to the present invention.

Referring to FIGS. 4 and 5, the lower housing 110 includes a metering block 136 mounted on inlet plate 108. Metering block has a piston bore 138 defined vertically and dimensioned for receiving integral piston 122. Pressure equalizer channels 140 are disposed parallel to and laterally spaced from piston bore 138. Integral piston 122 extends through a spacer bore 134 defined in spacer plates and into piston bore 138.

Metering block 136 has a fuel passage 142 extending laterally through the block 136 and intersecting piston bore 138, but not pressure equalizer channels 140. Fuel passage 142 is generally rectangular in shape, and communicates with fuel outlets 104 and 106 at opposite ends. Piston bore 138 extends through the floor of fuel passage 142, and communicates with fuel inlet 102. As shown in FIG. 4, the fuel outlets 104 and 106 (only outlet 106 is shown in FIG. 4, outlet 104 being symmetrical) are mounted on outlet plates 144, which are attached to opposite ends of the metering block with an intervening gasket 146.

The opposite ends of fuel passage 142 are wider than the central portion of the passage 142, having a recess defined in the end of the passage 142 in order to receive a rectangular sliding block valve 148 (only one shown in FIG. 4, the opposite end of the block 136 being symmetrical) which has a height only slightly less than the height of fuel passage 142, but a width which is much narrower than the width of fuel passage 142. Bores 150 are located above and below the passage on opposite sides of the sliding block valves 148. Adjustment screws 152 are threaded into internally threaded bores in sliding valve adjustment plate 154 and through gasket 156 and bores 150 on opposite sides of the metering block 136 to bear against sliding valves 148 and thereby determine the degree of restriction of the cross-sectional area of the fuel passage 142 adjacent the outlets 104 and 106 based upon the boost pressure desired, as described below. The sliding valves 148 are adjustable to leave the area of the fuel passage 142 substantially unrestricted, or may be moved into the fuel passage 142 to substantially restrict the flow of fuel through the enricher 100. Sealing plates 158 are clamped together on opposite sides of the enricher 100, being separated from the sliding valve adjustment plates 154 by gaskets 160. The sealing plates 158 prevent further adjustment of the sliding valves 148 after assembly of the enricher 100.

Figure 6:
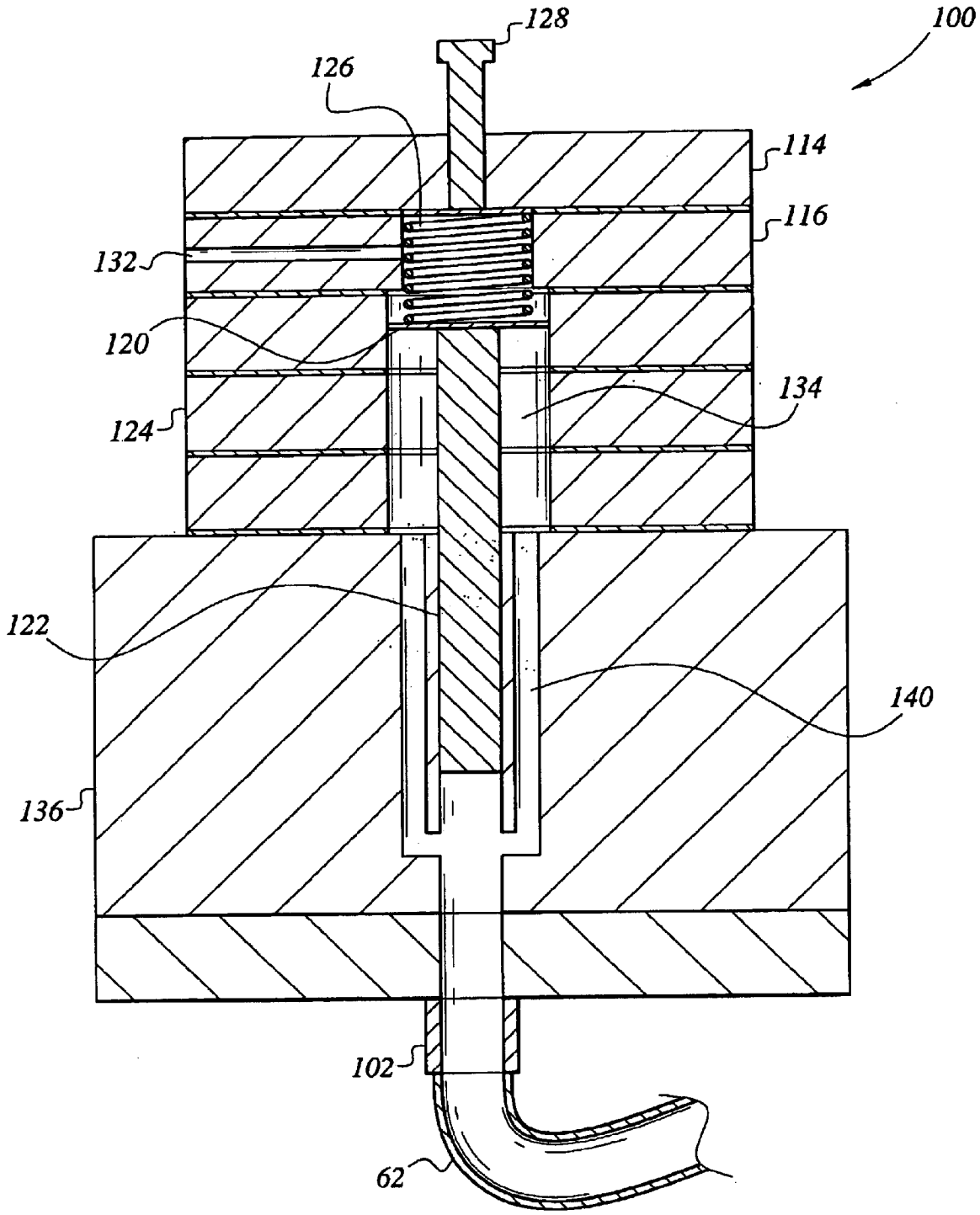
FIG. 6 is a section view along lines 6—6 of FIG. 1B showing the piston in a closed position.

FIG. 6 is a sectional view of the flow enricher 100 with the valve in the closed position. Since boost pressure in the fuel bowl 38 is at or below atmospheric pressure, spring 126 is expanded, forcing the integral piston 122 down to seat against the floor of fuel passage 142, thereby blocking the flow of fuel through the enricher 100.

Figure 7:
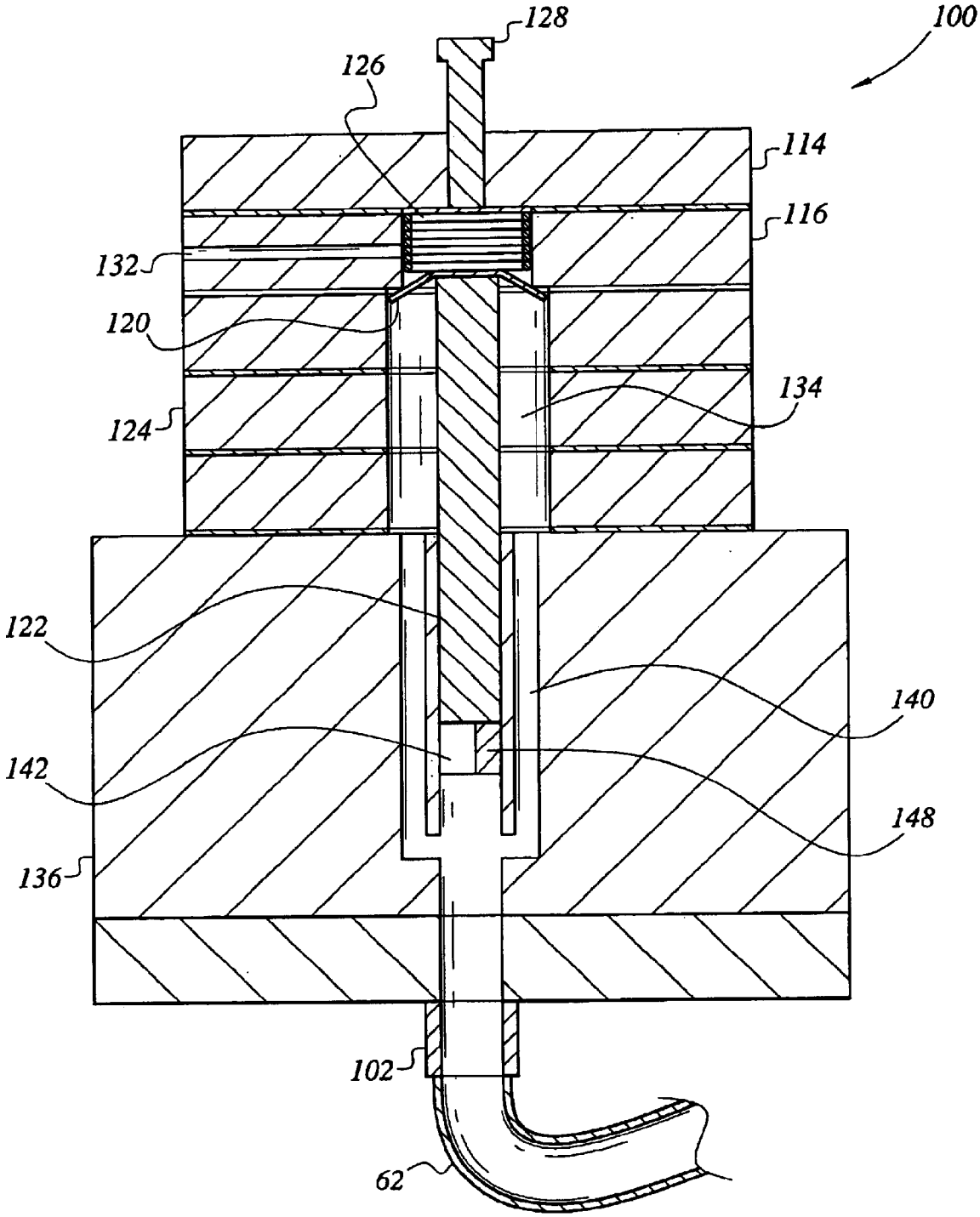
FIG. 7 is a section view similar to FIG. 6 with the piston in an open position.

FIG. 7 is a similar view, but with the valve open. Since pressure in the fuel bowl 38 is above atmospheric pressure, gas in the fuel bowl 38 is forced through the inlet and bears against the bottom of the integral piston 122, and also is carried through the equalizer channels to bear against the bottom surface of the diaphragm 120, thereby compressing the spring 126 and raising the integral piston 122, thereby opening fuel passage 142 for the flow of fuel through the enricher 100.

The procedure for calibrating the boost fuel enricher 100 will now be explained with reference to FIG. 8. Essentially, the problem encountered with using a supercharger or turbocharger with a carburetor designed for a naturally aspirated engine is that the carburetor is built for a limited airflow and the size of the main jets is limited to meter fuel for the maximum anticipated airflow at atmospheric pressure. The boost fuel enricher is designed to supplement the area of the main jets under conditions of increased airflow mass when operating under boost. The increased percentage flow of fuel for any desired boost pressure can be calculated from the following three equations:

$$(T_2/T_1)=(P_2/P_1)^{0.283} \quad (1)$$

where T is temperature, P is pressure, the subscript "1" refers to air before compression, and the subscript "2" refers to air after compression (equation [1] assumes an adiabatic efficiency of 100%);

$$(T_2-T_1)/0.60=\text{change in temperature} \quad (2)$$

assuming 60% efficiency of the compressor (in the real world, compressor efficiency is only about 70%; equation [2] conservatively corrects the temperature change for a compressor efficiency of 60%); and $$(n_2/n_1)=(P_2/P_1)*(T_1/T_2) \quad (3)$$

where n is the mass of the air.

Where an intercooler is used, equation 2 must be modified to account for the intercooler efficiency. For example, assuming the intercooler has an efficiency of 70%, equation 2 is modified as follows:

$$((T_2-T_1)/(0.60)*(1-0.70)=\text{change in temperature} \quad (4)$$

Figure 8:
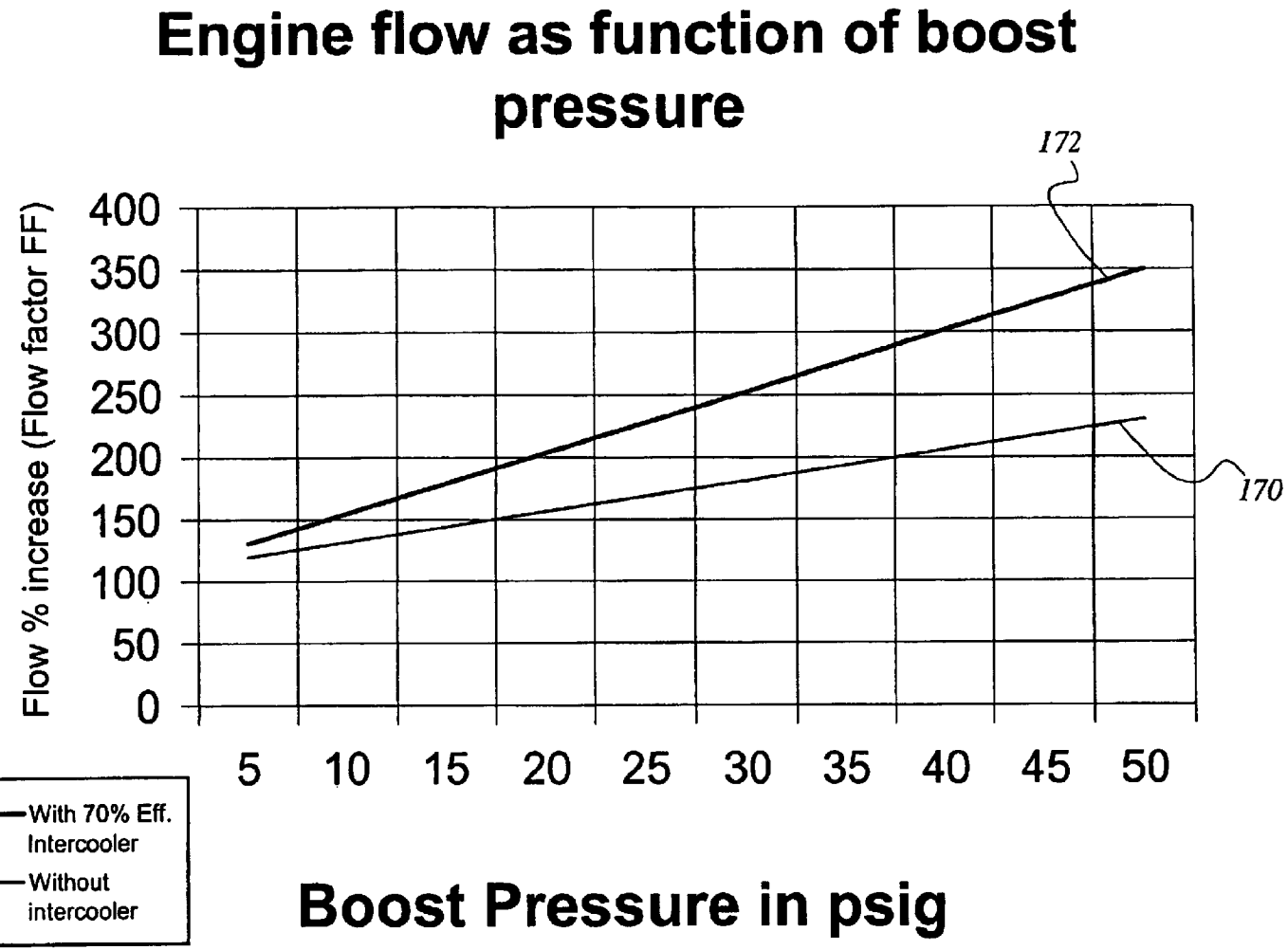
FIG. 8 is a chart of boost pressure versus flow factor for calibrating the sliding valves of the flow enricher.

A representative nomogram generated from the above equations is shown in FIG. 8. In order to calibrate the sliding valves 148, the technician determines the cross-sectional area of all of the main jets in the carburetor. The maximum desired boost pressure is located on the nomogram, and the increased percentage of fuel flow is determined from line 170 if no intercooler is used, or from line 172 if an intercooler is used. It is then a simple matter to determine the desired cross-sectional area of fuel passage 142 required to produce this additional fuel flow. From the cross-sectional area of the fuel passage 142, the height of the sliding valve 148, and the number of turns per inch of the sliding valve adjustment screws 152, the number of turns of the adjustment screws 152 to reduce the cross-sectional area of fuel passage 142 to the desired cross-sectional area may be determined.

The adjustment screws 152 on the side of the enricher 100 having the recess defined in the end of the fuel passage are loosened, and the screws 152 on the opposite side are tightened to fully retract the sliding valves 148 into the recess, whereupon the original screws 152 are tightened. Then the screws 152 on the side opposite the recess are loosened, and the screws 152 on the recess side are turned by the calculated number of turns required. Finally, the screws 152 on the side opposite the recess are tightened. Fuel flow can be measured. Any additional adjustment should require only 3–5% correction. The sealing plates 158 may then be reinstalled.

The bias spring adjustment screw 128 need only be adjusted to open the diaphragm valve when atmospheric pressure in the fuel bowl 38 is exceeded by the desired boost, e.g., 1 p.s.i.g.

It is to be understood that the present invention is not limited to the embodiments described above, but encompasses any and all embodiments within the scope of the following claims.

I claim:

1. A boost fuel enricher for use with an internal combustion engine equipped with an inlet air compressor, the boost fuel enricher comprising:

a valve housing having a fuel inlet, a fuel outlet, and a fuel passage defined between the fuel inlet and the fuel outlet, the fuel passage having a cross-sectional area defining a throat of the valve housing;

a diaphragm valve with an integral piston disposed within said valve housing;

a spring disposed within said valve housing and bearing against said diaphragm, the spring biasing said integral piston into the fuel passage in order to block fluid flow between the fuel inlet and the fuel outlet;

a discharge tube connected to said fuel outlet;

wherein the valve housing has a vent hole defined therein subjecting one side of said diaphragm to atmospheric pressure;

wherein said fuel inlet is adapted for connection to a fuel bowl vented to air intake pressure in the engine; and wherein said discharge tube is adapted for connection to a venturi disposed in an intake air passage of the engine, said spring being biased to raise the integral piston in the fuel passage in order to permit fuel to flow through the valve housing and discharge into the venturi when pressure at the fuel inlet exceeds atmospheric pressure.

2. The boost fuel enricher according to claim 1, further comprising a pair of pressure equalizer channels defined in said valve housing and extending between said fuel inlet and a surface of said diaphragm opposite the side subjected to atmospheric pressure.

3. The boost fuel enricher according to claim 1, wherein said fuel passage has a recess defined therein, the boost fuel enricher further comprising a sliding block valve disposed in the recess and slidable into the fuel passage, whereby the throat of the valve housing is adjustable in area.

4. The boost fuel enricher according to claim 1, wherein said discharge tube is adapted for insertion into the venturi of a carbureted internal combustion engine.

5. The boost fuel enricher according to claim 1, further comprising an auxiliary venturi adapted for insertion into the intake air passage of a fuel injected engine, said discharge tube being inserted into the auxiliary venturi.

6. A boost fuel enricher in combination with a carburetor adapted for attachment to an internal combustion engine having a compressor for applying a boost pressure to the engine, the boost fuel enricher comprising:

a carburetor having an air horn, a mouth defining an entrance to the air horn, a venturi defined in the air horn, a fuel bowl, a discharge tube connecting the fuel bowl to the venturi, and a bowl vent tube connected between the mouth of the air horn and the fuel bowl;

a valve housing having a fuel inlet, a fuel outlet, and a fuel passage defined between the fuel inlet and the fuel outlet, the fuel passage having a cross-sectional area defining a throat of the valve housing;

a diaphragm valve with an integral piston disposed within said valve housing;

a spring disposed within said valve housing and bearing against said diaphragm, the spring biasing said integral piston into the fuel passage in order to block fluid flow between the fuel inlet and the fuel outlet;

a discharge tube connected to said fuel outlet;

wherein the valve housing has a vent hole defined therein subjecting one side of said diaphragm to atmospheric pressure;

wherein said fuel inlet is connected to the fuel bowl of said carburetor; and wherein said discharge tube is connected to the venturi of said carburetor, said spring being biased to raise the integral piston in the fuel passage in order to permit fuel to flow through the valve housing and discharge into the venturi when pressure in the fuel bowl exceeds atmospheric pressure.

7. The boost fuel enricher according to claim 6, further comprising a pair of pressure equalizer channels defined in said valve housing and extending between said fuel inlet and a surface of said diaphragm opposite the side subjected to atmospheric pressure.

8. The boost fuel enricher according to claim 6, wherein said fuel passage has a recess defined therein, the boost fuel enricher further comprising a sliding block valve disposed in the recess and slidable into the fuel passage, whereby the throat of the valve housing is adjustable in area.

* * * * *